US006647220B2

(12) United States Patent
Wang et al.

(10) Patent No.: US 6,647,220 B2
(45) Date of Patent: Nov. 11, 2003

(54) SYSTEM AND METHOD FOR CONDITIONING A TONER BEFORE DEVELOPMENT

(75) Inventors: Fong-Jen J. Wang, deceased, late of Pittsford, NY (US), by Su-Shu Chang, legal heir; Gerald A. Domoto, Sleepy Hollow, NY (US); Edward B. Caruthers, Jr., Webster, NY (US); R. Enrique Viturro, Webster, NY (US)

(73) Assignee: Xerox Corporation, Stamford, CT (US)

( * ) Notice: Subject to any disclaimer, the term of this patent is extended or adjusted under 35 U.S.C. 154(b) by 87 days.

(21) Appl. No.: 10/042,003

(22) Filed: Oct. 19, 2001

(65) Prior Publication Data

US 2003/0077090 A1 Apr. 24, 2003

(51) Int. Cl.[7] ..... G03G 15/00

(52) U.S. Cl. ..... 399/49; 399/57; 399/233; 430/117

(58) Field of Search ..... 399/27, 28, 29, 399/57, 233, 237, 248, 39, 49, 54, 253, 223; 430/117, 118, 119

(56) References Cited

U.S. PATENT DOCUMENTS

| | | | | | |
|---|---|---|---|---|---|
| 5,369,476 | A | * | 11/1994 | Bowers et al. | 399/49 |
| 5,557,393 | A | * | 9/1996 | Goodman et al. | 399/223 |
| 5,713,062 | A | * | 1/1998 | Goodman et al. | 399/49 |
| 5,781,828 | A | * | 7/1998 | Caruthers et al. | 399/57 |
| 5,897,239 | A | * | 4/1999 | Caruthers et al. | 399/54 |
| 5,933,685 | A | * | 8/1999 | Yoo | 399/57 |

* cited by examiner

*Primary Examiner*—Robert Beatty
(74) *Attorney, Agent, or Firm*—Oliff & Berridge, PLC

(57) ABSTRACT

An image forming system and method of using the system includes a development station for developing an image, a replenishing source that stores toner mixed to a desired color and comprising at least two toner component colors, a conditioning station that conditions the toner before sending the toner to a developing station, and a drawing device that draws a portion of the toner in the conditioning station. The drawing device will remove a portion of at least one component color of the toner until the desired color is suitable for developing. The system and method will help to produce images of a desired color in liquid immersion development of color prints. With the use of the drawing device, consistent colored images can be achieved while reducing waste of toner.

17 Claims, 4 Drawing Sheets

FIG. 3A
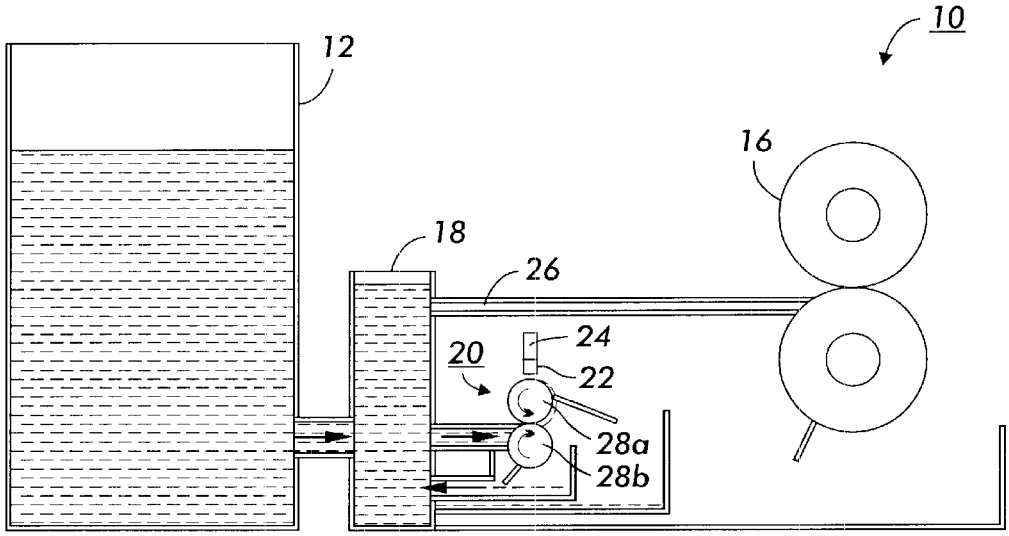
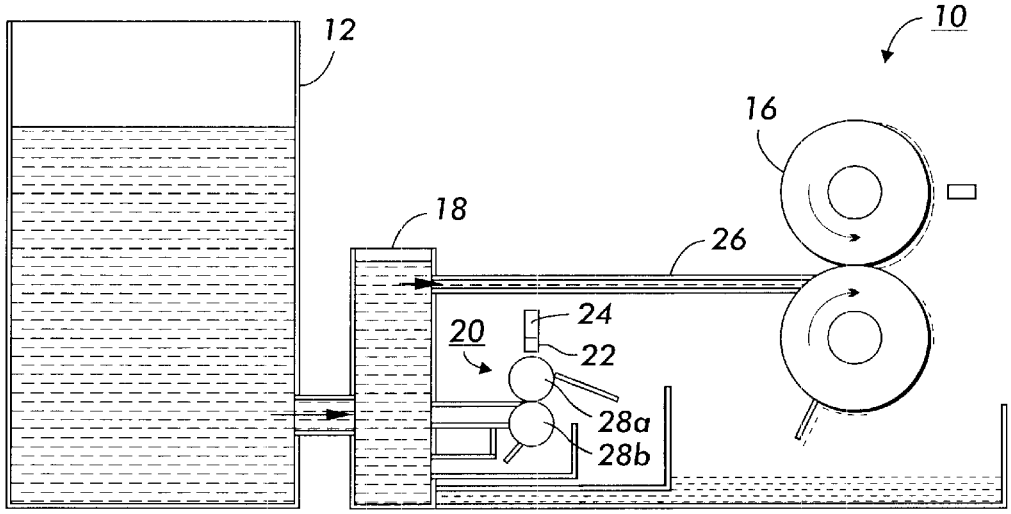
FIG. 3B

SYSTEM AND METHOD FOR CONDITIONING A TONER BEFORE DEVELOPMENT

TECHNICAL FIELD

The present invention relates generally to electrophotographic printing in image forming systems, and specifically relates to liquid immersion development of color prints.

BACKGROUND OF THE INVENTION

Electrophotographic systems employing liquid immersion development (LID) technologies are well known. These types of systems typically include an image bearing member or photoreceptor having an image bearing surface on which latent images are formed and developed as single color or multiple color toner images for eventual transfer to a receiver substrate or copy sheet. Such electrophotographic systems also include a development station that utilizes a liquid developer material typically having about 2 percent by weight of charged, solid particulate toner material of a particular color, that is dispersed at a desired concentration in a clear liquid carrier.

In the electrophotographic process of a LID system, the latent images formed on the image bearing surface of the image bearing member or photoreceptor are developed with the charged toner particles, with excess liquid carrier being left behind or removed such that the developed images typically each contain about 12 percent by weight of the toner particles. The developed image or images on the image-bearing member are then further conditioned and subsequently electrostatically transferred from the image-bearing surface to an intermediate transfer member. Following that, the conditioned image or images are then hot or heat transferred from the intermediate transfer member, at a heated transfer or transfix nip, to an output image receiver substrate or copy sheet.

The ink or liquid developer material in conventional LID systems is about 2% solids (by weight) and developed images are on the order of 10%–15% solids (by weight). Such LID systems also include a biased metering roll for metering an amount of carrier fluid in the ink as well as for developing images with the metered ink. Fluid metering as such, and image development, are conventionally carried out separately, and typically by using a reverse rolling or moving metering roll.

LID systems typically also condition the initial ink developed image to provide increased image stability by conditioning the toner before it is transferred to the development station. Such conditioning is often achieved in conditioning stations that are supplied toner by a replenishing source.

LID systems utilize a technology known as "pantoning." This process develops images using LID Pantone® inks. By mixing fourteen Pantone® basic colors, over a thousand colors can be achieved for producing high-quality prints. This ability to print Pantone® colors or Pantone® inks is one of the desirable features of liquid ink electrophotography. In addition, the use of a wet instead of a dry toner in LID systems produces high quality prints, and is especially useful in short-run productions where the use of some lithographic techniques are cost prohibitive.

To obtain high-quality prints having a Pantone® color, the toning process combines development, ink application, sump management, and control hardware and methodology. However, because of intrinsic properties of the Pantone® ink, the toned color produced by the development hardware can deviate from the expected print color if conventional toning processes are used. In particular, colors of the final print may not resemble those intended, resulting in poor quality prints.

SUMMARY OF THE INVENTION

Systems and methods are described herein for implementing a toning process designed to minimize and stabilize color deviation on a substrate, since conventional LID toning processes are not enough to deliver a robust product. Described below is a toning process that incorporates a toner conditioning station, which enables robust Pantone® prints, while significantly reducing the setup time required by the toning process.

For an effective and robust pantoning process, an ink conditioning station is described herein. The device establishes the proper mixture for any Pantone ink with the aid of an additional plate-out or drawing device and calorimeter before the ink is applied to the development station.

The ink conditioning station, which is designed and optimized to provide a quick setup and generate minimum waste, can be coupled with calorimeters and feedback control to allow automatic switching between the setup mode and the operational mode.

The ink conditioning station, which is designed and used in the setup mode, can also be operated in the operational mode with continuous plate-out and color monitoring. It therefore can serve the function of on-the-fly ink conditioning to maintain the ink stability if any disturbance occurs.

The Pantone mixture is established and maintained in the ink conditioning station. This Pantone mixture is different than the mixture of the toned images and the replenishing Pantone mixture. In one embodiment, the Pantone mixture can be prepared and poured into the conditioning station according to a pre-determined recipe.

The Pantone mixture, maintained in the Pantone ink replenishing source, has the same color mixture as the intent print color. The Pantone mixture is directed to the ink conditioning station. Once equilibrium is established and the toning process starts, little waste is generated.

The conditioned premix is manufactured along with the corresponding Pantone mixture for printing, and can be provided to the customers (in relatively small amounts) together with the given Pantone mixture. Such a use of the premix allows an instant setup with little waste.

In particular, an image forming system for producing an image of a desired color on a substrate is described herein. The system includes a conditioning station for conditioning a toner prior to forming the image on the substrate, and a drawing device to draw a portion of the toner from the conditioning station. The system also includes a control device coupled to the drawing device for sending a signal to form the image on the substrate if the drawn toner is suitable for producing the desired color.

Also described herein is a method for producing an image of a desired color on a substrate. The method includes filling a conditioning station with a toner, and drawing a portion of the toner from the conditioning station. Subsequently, the portion of the toner is analyzed to determine whether the toner is suitable for producing the desired color. Then, provided the toner is suitable for producing the desired color, the toner is fed to a development station for producing the image of the desired color on the substrate.

BRIEF DESCRIPTION OF THE DRAWINGS

FIGS. 3A and 3B are schematic illustrations of the operation of a drawing device during the set-up and the operational mode, according to the teachings of the present invention.

DETAILED DESCRIPTION OF THE INVENTION

An image forming system is provided herein that can produce colored images on a substrate. Image forming systems include electrophotographic, electrostatic or electrostatographic, ionographic, and other types of image forming or reproducing systems that are adapted to capture and/or store image data associated with a particular object, such as a document. The system of the present invention is intended to be implemented in a variety of environments, such as in any of the foregoing types of image forming systems, and is not limited to the specific systems described below.

Differences in the intrinsic properties of Pantone® inks can result in poor quality color prints. For example, differences in the toning rates, or plate-out rates, among the approximately fourteen Pantone® basic colors, which are mixed to produce over a thousand colors, cause the relative fraction of the basic colors on a substrate, such as paper, to deviate from a desired mixture.

The difference in toning rates is mainly determined by the electrophoretic mobility of the toner particles. LID toner particles, the pigmented resin imbedded with charge control agents (CCA), acquire their charges through charge exchange with the surrounding charge director micelles (counter ions). Pigment itself significantly affects the charging level and, therefore, the toner particle mobility and toning rates. For example, Pantone® 347, a color whose hue is somewhat dark green, is a mixture of two Pantone® basic colors, "Pantone® Process Blue" and "Pantone® Yellow", with a mass fraction of 62.5% and 37.5% respectively. Because of the variation in charging, the "blue" and the "yellow" particles have different mobilities and toning rates. Thus, if Pantone® 347 ink is added to a sump and fed to a standard toning station, the out-coming color of the prints differ from the color of original Pantone® 347.

The degree of deviation mostly depends on the difference in the mobility. Let, $C_i$=Concentration of Toner Species i (g/cm$^3$)

$\mu_i$=Mobility of Toner Species i (cm$^2$/V-sec)

$K_i$=Developability Constant of Toner Species i=K

V=Sump Volume (cm$^3$)

$\psi_i$=Ink Replenishing Rate (cm$^3$/sec)

Then the product of $K_i$, the developability constant, with the mobility, $\mu_i$, relates the developed mass to the toner concentration in a well replenished toning process:

$$\Delta m_i = K_i \mu_i C_i \quad (1)$$

The developability constant, $K_i$, of a given toner species i, is determined by the related process parameters, such as the local electrostatic field, and the duration of development time. Often, one can assume that the developability constant is constant across species, in which case the subscript can be dropped in favor of a constant K valid for all species. The mobility is determined by the charge of the particle as well as other variables, such as viscosity of the carrier fluid, and size of the toner particles.

Figure 1:
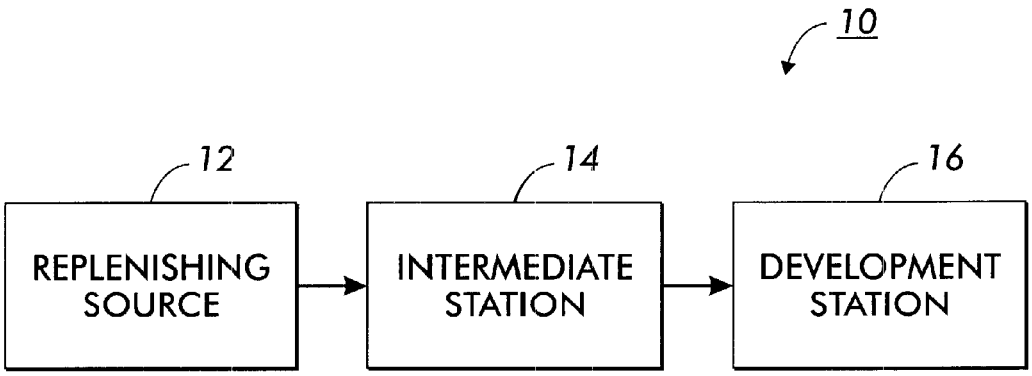
FIG. 1 is a schematic representation of an image forming system for producing a desired color on a substrate, according to the teachings of the present invention.

Referring to FIG. 1, an image forming system 10 for producing a desired color on a substrate is shown. The image forming system 10 includes a replenishing source 12, an intermediate station 14, and a development station 16.

The development station 16 transfers toner to the substrate, such as paper, for producing an image thereon. The development station 16 can undertake various processes for forming a latent charge image, including optical image projecting onto a charged photoconductive belt or drum, charging a dielectric member with an electrostatic pin array or electron beam, and charge projection from an ionographic print cartridge or from a plasma generator. Once a latent image is formed, the latent image may be transferred to an intermediate member before final development. Alternatively, the latent image may be developed on the same member as that on which it is formed, with different system architectures having evolved to address different process priorities, such as cost, speed, preferred type of toning system or intended receiving substrate.

The replenishing source 12 contains a reservoir for storing toner. The replenishing source 12 supplies toner to the development station 16 via the intermediate station 14. The intermediate station 14 conditions and helps to regulate the color of the image produced on the substrate.

Figure 2:
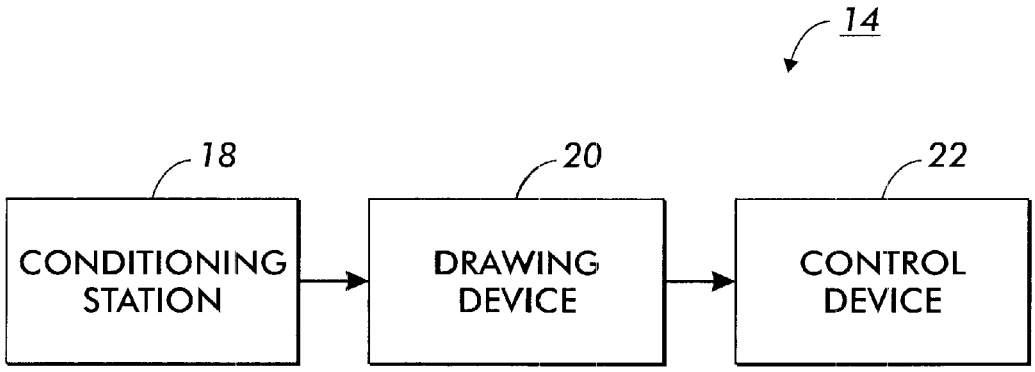
FIG. 2 is a schematic representation of an intermediate station, for producing a desired color on a substrate, of the image forming system shown in FIG. 1, according to the teachings of the present invention.

Referring to FIG. 2, the intermediate station 14 of the image forming system 10 is shown in more detail. The intermediate station 14 includes a conditioning station 18, or sump, which is coupled to a plate-out or drawing device 20 and a control device 22.

The conditioning station 18 conditions the toner before transferring the toner to the development station 16. Toner conditioning and feeding to the development station 16 is commonly done gravitationally, or mechanically along with agitation to prevent agglomeration or lumping of toner particles. Such lumping makes it difficult to develop the image uniformly, detect the toner level, and can result in print deletions. In addition, a stream of gas may be used to convey the toner to different parts of the development station 16. The stream of gas helps prevent the toner from lumping.

The drawing device 20 draws toner from the conditioning station 18 thereby shortening the time required for the toner concentrations to reach equilibrium in the development station 16, and helping to achieve better quality prints. The control device 22 is coupled to the drawing device 20 and sends a signal to the development station 16 to produce the image on the substrate if the drawn toner is within an acceptable color range. The control device 22 can include a processor and/or memory for initiating electronic signals that feed toner to the development station 16 once the toner drawn by the drawing device 20 is determined to be appropriate for producing the desired color. The drawing device 20 can consist of a pair of electrically conductive rollers with a potential difference across them. The potential difference creates an electric field whose direction can cause the charged liquid toner particles to migrate to the upper roll as shown in FIG. 3A or 3B. The deposited toner is measured calorimetrically and removed by a scraper blade. The control device 22 can include a microprocessor that monitors the colorimeter and signals the main machine controller that the ink was sufficiently conditioned to begin image development. The microprocessor also turns off the electric field in the drawing device when toner removal is not desired. In addition, the microprocessor can occasionally monitor the state of the ink and take corrective action if the colorimeter shows the ink to be outside of preset bounds. The drawing devices include electrode surfaces and make use of the application of an electric field to cause toner deposition. A pair of rotating rolls allows the use of a scraper blade for toner removal.

In particular, let $R_s$, $R_p$, and $R_r$ represent the ratio of the concentrations of species x and y in the conditioning station 18 or sump, the development station 16, which is also the ratio on the print, and the replenishing source 12, respectively. That is $$R_s(\text{Sump Ratio}) = \frac{C_{xs}}{C_{ys}}$$

$$R_p(\text{Print Ratio}) = \frac{C_{xp}}{C_{yp}}$$

$$R_r(\text{Replenishing Ratio}) = \frac{C_{xr}}{C_{yr}}$$

where, for example, $C_{xs}$ and $C_{ys}$ are the toner concentrations of species x and y, the two Pantone basic colors, in the sump. The hue of each Pantone® ink mixture, whether it is in the conditioning station 18 or sump, on the print, or from the replenishing source 12, is essentially determined by the respective ratio defined above. The ideal case is $R_s=R_p=R_r$. However, these ratios are not the same owing to the difference in mobility. From Eq. (1), the developed mass ratio on the print is given by $$\frac{\Delta m_x}{\Delta m_x} = \frac{C_{xp}}{C_{yp}} = \frac{\mu_x C_{xs}}{\mu_y C_{ys}}$$

Therefore, $$R_s = \frac{\mu_y}{\mu_x} R_p \tag{2}$$

Eq.(2) defines the required mixture in the sump for a desired print color. If the replenishing mixture is kept at the same mixture ratio as the desired print ratio, then $$R_r = R_p \tag{3}$$

After a relaxation time, the system eventually reaches equilibrium and the sump then remains in the state described by Eq. (2). The dynamics in the sump is governed by the following equation, which expresses conservation of mass:

$$\frac{d(C_x V)}{dt} = C_{xr}\psi - K\mu_x C_x \tag{4}$$

where $C_x$ is the toner concentration of species x in the conditioning station 14 or sump. The ink volume in the conditioning station 18, V, the developability, K, the mobility, $\mu_x$, and the concentration of the replenishing ink, $C_{xr}$, are all held constant and are therefore independent of time. A similar equation governs the time evolution of species y. The solution of Eq. (4) is $$C_x = \left(C_x^0 - \frac{C_{xr}\psi}{K\mu_x}\right)\exp(-K\mu_x t/V) + \frac{C_{xr}\psi}{K\mu_x} \tag{5}$$

where $C_x^0$ is the initial toner concentration of species x. As the time approaches infinity, the concentrations approach the equilibrium values:

$$C_x = \frac{C_{xr}\psi}{K\mu_x} \text{ and } C_y \frac{C_{yr}\psi}{K\mu_y} \tag{6}$$

Therefore, combining Eqs. (3) and (6), $$R_s = \frac{C_x}{C_y} = \frac{\mu_y}{\mu_x} R_r = \frac{\mu_y}{\mu_x} R_p \tag{7}$$

which gives the same relationship as stated in Eq. (2). At equilibrium, the concentrations in the conditioning station 18 or sump are given by Eq. (2).

Equations (5) and (7) imply that the concentrations in the conditioning station 18 eventually reach equilibrium, and that at equilibrium the print color is the same as that in the replenishing source 12, provided that a constant supply of the right Pantone® mixture is maintained, in accordance with Equation (3).

The relaxation time, the time at which the first term in Eq. (5) is negligible compared to the second term, is the time required for the color deviation to be within specifications. Before equilibrium is reached, prints produced by the development station 16 may not have acceptable colors, and are typically discarded by the user of the image forming system 10. The relaxation time, $V/K\mu$, indicates that the smaller the sump or the larger the developability and toner mobility, the shorter the time required to achieve relaxation.

Referring to FIGS. 3A and 3B, a schematic illustrating the operation of the drawing device 20 during the set-up and the operational modes is shown. A colorimeter 24 is coupled to the drawing device 20 and to the control device 22. A feed tube 26 transfers toner from the conditioning station 18 to the development station 16.

The Pantone replenishing station 12 contains, and is replenished with, the desired Pantone ink mixture whose color becomes the print color on the substrate. The replenishing station 12 is connected to the conditioning station 18, which directly supplies the ink to the development station 16 for the final toning of the latent images. The conditioning station 18 serves the purpose of conditioning the Pantone mixture, in the setup mode shown in FIG. 3A, so the right ratio or color can be established before the ink is applied to the development station 16. After the initial setup mode shown in FIG. 3*a,* the preferred operational mode shown in FIG. 3B is established. In the operational mode shown in FIG. 3B, the sump concentration ratio, $R_s$, is maintained at the level defined in Eqs. (2) and (3), relative to the replenishing ratio, $R_r$ and the identical print ratio, $R_p$.

The conditioning is accomplished with the use of a drawing device 20, e.g., a pair of rotational rollers 28A and 28B, or other electrostatic development device. This device is distinct from the development station 16 where the final prints are generated. In the setup mode shown in FIG. 3A, a portion of the original Pantone mixture is developed to one roller 28A of the drawing device 20 and discarded, and the remaining ink, carried by the other roller 28B, is fed back to the conditioning station 18, or sump. Since the sump volume, V, is relatively small, the equilibrium and the right mixture ratio is established rather quickly. A calorimeter 24 is used to monitor the plate-out color on the roller 28A. Only when the color plated out matches well with the intended print color, the setup mode shown in FIG. 3A is considered finished. Then, the "conditioned ink" in the ink conditioning station 18 can be further directed to the development station 16 for the final toning in the operational mode shown in FIG. 3B. The setup mode can be enhanced by operating the drawing device 20 so that the developability is maximized. For example, a high field, high speed process combining with a wide development area (e.g., long rollers) can be used. This has the effect of shortening the setup time, $V/K\mu$, by reducing the sump volume, V. and increasing the developability, K. In addition, the ink conditioning station 18 can then be run in a continuous fashion during the printing process to continuously monitor and correct the conditioning sump concentration if required. This continuous monitoring is done at a reduced developability to conserve toner.

As an illustrative example, suppose a customer color "green" is best matched by the Pantone mixture 347, which is placed in the Pantone ink container. Pantone 347 is made of the mixture of "Pantone Process Blue" and "Pantone Yellow" with a mass fraction of 62.5% and 37.5% respectively, that is, $R_p$, and $R_r$ are 1.67. Suppose further that the "Pantone Process Blue" toner mobility is twice as high as the "Pantone Yellow" mobility. Therefore, according to (2), Rs should be maintained at 0.83. In other words, more "Pantone Yellow" than the "Pantone Process Blue" is required in the conditioning station 16, opposite to the composition of Pantone 347 prescribed by conventional techniques. During the setup mode shown in FIG. 3A that utilizes the drawing device 20, the excessive "Pantone Process Blue" is plated out and removed, while the remaining ink with higher content of the "Pantone Yellow" is fed back to the conditioning station 18.

During this setup process, the color in the conditioning sump will change and eventually turn into a fixed color, indicating that equilibrium has been established. The color of the plate-out is monitored constantly, which enables an automatic switch from the setup mode of FIG. 3A to the regular operational mode of FIG. 3B soon after equilibrium is reached. An additional colorimeter can be used to measure the color of the toned image during the regular operational mode, and the conditioning station 18 can be re-activated if a growing color deviation is sensed from the prints.

An apparatus that is similar to the conditioning station 18 can also be used as an individual device to determine the right "conditioned mixture" for any given Pantone color that meets the customer color requirement. That is, in addition to a specific Pantone ink that customers require, a separated batch of "conditioned ink," or "conditioned premix," automatically determined by such an apparatus, can be separately manufactured and provided to customers as well. Such a conditioned premix is poured into the conditioning station 18 in the customer's pantoning printers, resulting in minimum or no waste during the setup mode.

Once equilibrium is established and the toning process starts, little waste is generated. In conventional methods, the first several substrates are typically discarded because the image does not have the desired color. The present invention obviates the need to discard the first several substrates because after the set up mode is completed, a process that does not involve the discarding of substrates, the desired color is maintained in the images on the substrate. Moreover, according to the principles of the present invention, the set up mode, in which equilibrium is established, can be completed expeditiously by decreasing the relaxation time $V/K\mu$. Thus, the fast plate-out rate and the small conditioner sump volume described above result in quick setup and little waste generation compared to conventional ink conditioning methods.

Figure 4:
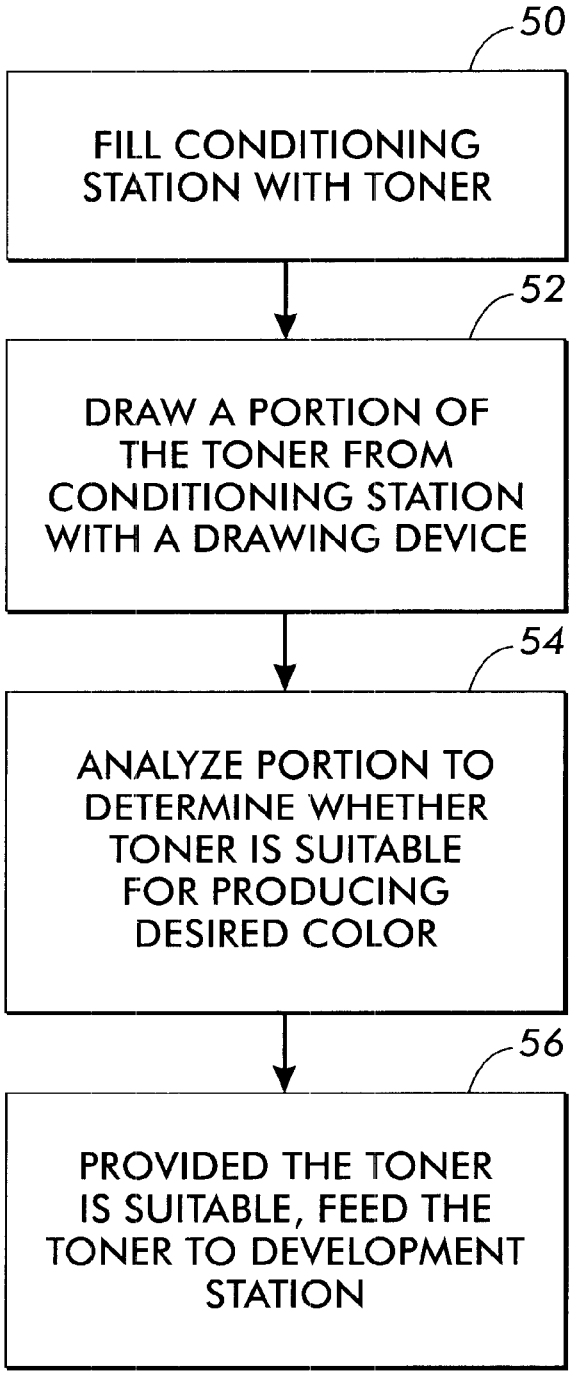
FIG. 4 shows a flow chart indicating steps for producing an image of a desired color on a substrate, according to the teachings of the present invention.

Referring to FIG. 4, a flow chart is presented describing a method for producing an image of a desired color on a substrate. In step 50, a conditioning station 18 is filled with a toner. In step 52, a portion of the toner is drawn from the conditioning station 18 with the use of a drawing device 20. Next, in step 54, the portion of the toner is analyzed to determine whether the toner is suitable for producing the desired color. A drawing device 20 having a first roller together with a colorimeter 24 can be used for this purpose. In particular, a sample of the portion of toner drawn by the drawing device 20 can be developed to the first roller, and its color measured by the calorimeter. In step 56, provided the toner is suitable for producing the desired color, the toner is fed to a development station 16 for producing the image of the desired color on the substrate.

Figure 5:
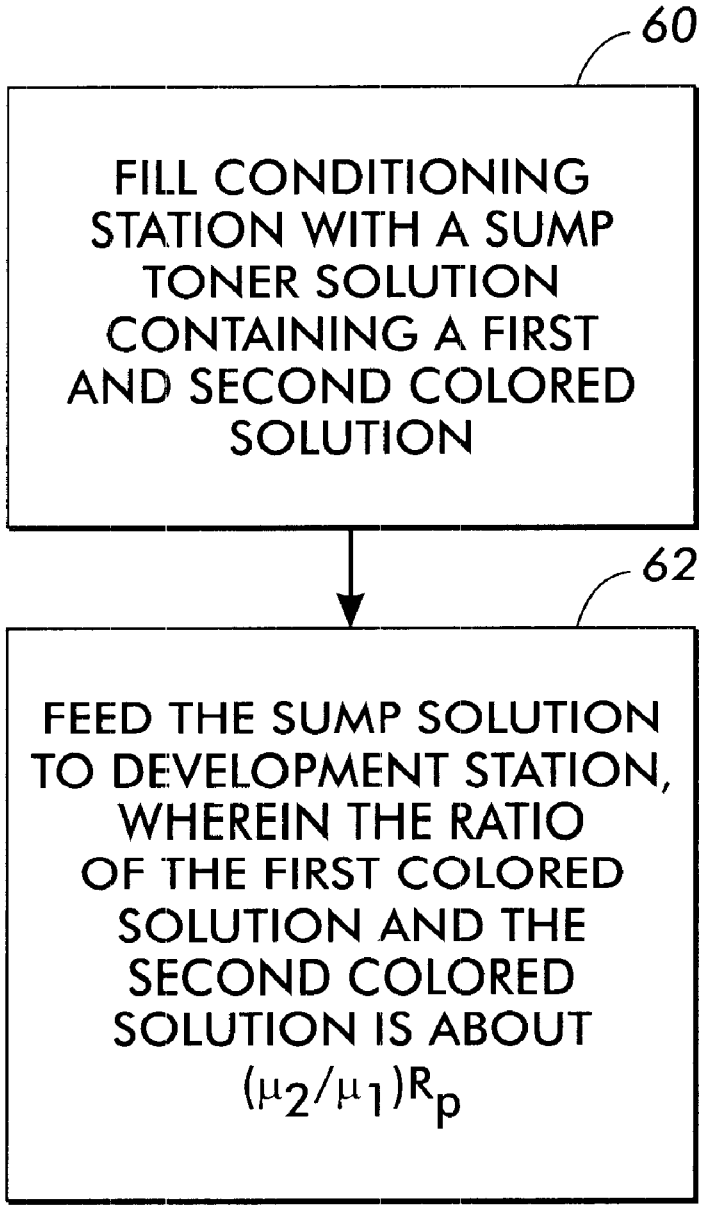
FIG. 5 is a flow chart describing a method for producing an image of a desired color on a substrate, according to the teachings of the present invention

Referring to FIG. 5, a flow chart is presented describing a method for producing an image of a desired color on a substrate. The toner solution contains a first solution of a first species and a second solution of a second species, the ratio of the first solution to the second solution being $R_p$. In step 60, a conditioning station 18 is filled with a sump toner solution containing the first colored solution and the second colored solution. In step 62, the sump solution is fed to a development station 16 for forming the image on the substrate, wherein the ratio of the first colored solution to the second colored solution in the sump toner solution is substantially $(\mu_2/\mu_1)$ $R_p$. Here, $\mu_1$ and $\mu_2$ are mobilities of the first species and the second species, respectively.

Those skilled in the art will recognize, or be able to ascertain using no more than routine experimentation, many equivalents to the specific embodiments and methods described herein. Such equivalents are intended to be encompassed by the scope of the following claims.

What is claimed:

1. An image forming system for producing an image of a desired color on a substrate, the system comprising:

a replenishing source that stores toner mixed to obtain the desired color, the mixed toner comprising at least two component colors;

a conditioning station that conditions a toner prior to forming the image on the substrate;

a drawing device that draws a portion of the toner from the conditioning station, the drawing device removing a portion of at least one component color until the toner is suitable for producing the desired color;

a control device, coupled to the drawing device, that sends a signal to form the image on the substrate once the drawn toner is suitable for producing the desired color.

2. The system of claim 1, further comprising a development station that transfers toner to the substrate, wherein the development station and the drawing device are connected in parallel to the conditioning station.

3. The system of claim 1, further comprising a colorimeter useable to test a color derived from the portion of the toner drawn from the conditioning station by the drawing device.

4. The system of claim 1, wherein the drawing device includes at least one rotational roller usable to draw the portion of the at least one component color to be removed from the conditioning station.

5. The system of claim 1, wherein the drawing device includes a first roller and a second roller such that a portion of the at least one component color to be removed is developed using the first roller, and a portion of at least one of the remaining component colors is returned to the conditioning station by the second roller.

6. A method for producing an image of a desired color on a substrate, the method comprising:

filling a replenishing station with a toner mixed to obtain the desired color, the mixed toner comprising at least two component colors;

directing a portion of the mixed toner from the replenishing station to a conditioning station;

drawing a portion of the mixed toner from the conditioning station;

analyzing the drawn portion of the mixed toner to determine whether the toner is suitable for producing the desired color;

adjusting a mixture of the mixed toner in the conditioning station by removing a portion of at least one of the at least two component colors;

feeding the toner to a development station when the toner is suitable for producing the desired color; and producing the image of the desired color on the substrate.

7. The method of claim 6, further comprising the step of ceasing to draw the portion of the mixed toner prior to feeding the toner to the development station.

8. The method of claim 6, wherein drawing the portion of the mixed toner comprises drawing the portion of the mixed toner continuously as the image of the desired color is being produced on the substrate.

9. The method of claim 6, wherein filling the replenishing station further comprises maintaining a volume of the toner in the replenishing station substantially constant.

10. The method of claim 6, wherein, analyzing the drawn portion comprises determining a color derived from the withdrawn portion of the mixed toner with a colorimeter.

11. The method of claim 6, further comprising developing a the drawn portion of the mixed toner with a first roller to determine the color of the developed portion.

12. The method of claim 6, further comprising returning a fraction of the drawn portion of the mixed toner to the conditioning station using a second roller, the returned portion having a different amount of at least one of the at least two component colors compared with the developed portion.

13. A method of forming an image of a desired color on a substrate utilizing a toner solution of the desired color containing a first solution of a first species and a second solution of a second species, the ratio of the first solution to the second solution being Rp, the method comprising:

mixing a toner solution in a conditioning station, the toner solution containing the first solution and the second solution;

drawing a portion of the toner solution out of the conditioning station;

removing a first fraction of the drawn portion;

returning a second fraction of the drawn portion to the conditioning station, the second fraction having a ratio substantially different from Rp, until the ratio of the first solution and the second solution drawn out of the conditioning station is substantially the same as Rp; and feeding the toner solution to a development station to form the image on the substrate.

14. The method of claim 13, further comprising:

analyzing the portion of the toner solution to determine whether the toner solution is appropriate to obtain the desired color;

feeding the toner to a development station when the toner solution is appropriate to obtain the desired color; and producing the image of the desired color on the substrate.

15. The method of claim 14, wherein analyzing the portion of the toner solution comprises using a first roller to develop the first fraction of the portion of the toner solution to determine whether the toner solution is appropriate to obtain the desired color.

16. The method of claim 15, wherein, returning the second fraction comprises using a second roller to return the second fraction of the portion to the conditioning station.

17. The method of claim 15, wherein analyzing the portion of the toner solution comprises using a colorimeter to determine a color derivable from the first fraction.

* * * * *